US009755339B2

(12) United States Patent
Jinno et al.

(10) Patent No.: US 9,755,339 B2
(45) Date of Patent: Sep. 5, 2017

(54) CONNECTING STRUCTURE OF CONNECTOR AND FLAT CIRCUIT BODY

(71) Applicant: Yazaki Corporation, Minato-ku, Tokyo (JP)

(72) Inventors: Keishi Jinno, Makinohara (JP); Kouichi Ohyama, Makinohara (JP); Kazunori Miura, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 14/267,968

(22) Filed: May 2, 2014

(65) Prior Publication Data

US 2014/0242847 A1 Aug. 28, 2014

Related U.S. Application Data

(63) Continuation of application No. PCT/JP2012/079046, filed on Nov. 2, 2012.

(30) Foreign Application Priority Data

Nov. 4, 2011 (JP) ..... 2011-242486

(51) Int. Cl.
*H01R 12/77* (2011.01)
*H01R 12/72* (2011.01)
(Continued)

(52) U.S. Cl.
CPC ..... *H01R 12/72* (2013.01); *H01R 12/774* (2013.01); *H01R 12/91* (2013.01); *H01R 2107/00* (2013.01)

(58) Field of Classification Search
CPC ..... H01R 12/7076; H01R 12/79
(Continued)

(56) References Cited

U.S. PATENT DOCUMENTS 6,482,027 B2 * 11/2002 Ishii et al. ..... 439/495
7,762,826 B2 * 7/2010 Hemmi ..... H01R 13/193 439/260
2002/0045381 A1 4/2002 Ishii et al.

FOREIGN PATENT DOCUMENTS

JP H07-019978 4/1995
JP 2006-085989 A 3/2006

OTHER PUBLICATIONS

Jan. 28, 2015—(KR) Office Action—App No. 10-2014-7011738.
(Continued)

*Primary Examiner* — Renee Luebke
*Assistant Examiner* — Paul Baillargeon
(74) *Attorney, Agent, or Firm* — Banner & Witcoff, Ltd.

(57) ABSTRACT

A connecting structure includes a flat circuit body, a slider that is attached to a vicinity of a distal end portion of the flat circuit body, and a connector which includes a slider containing portion and a terminal arrangement portion. When the slider is connected to the slider containing portion, conductors of the flat circuit body are electrically connected to the connection terminals of the terminal arrangement portion. The slider has a narrow width end portion whose width at the distal end is smaller than width of the flat circuit body so that side edges of the distal end of the flat circuit body are projected from the narrow width end portion. The slider containing portion has a positioning face which contacts with one of the side edges of the distal end of the flat circuit body.

5 Claims, 17 Drawing Sheets

(51) Int. Cl.
*H01R 12/91* (2011.01)
*H01R 107/00* (2006.01)

(58) Field of Classification Search
USPC ..... 439/67, 77, 60, 329, 377
See application file for complete search history.

(56) References Cited

OTHER PUBLICATIONS

International Search Report issued in International Application No. PCT/JP2012/079046 dated Jan. 22, 2013.
Written Opinion issued in International Application No. PCT/JP2012/079046 dated Jan. 22, 2013.
Aug. 25, 2015—(CN) Notification of the First Office Action—App 201280054143.X.
Aug. 17, 2015—(KR) Notice to Submit Response—App 10-2014-7011738.
Dated Apr. 19, 2016—Notification of the Second Office Action—App 201280054143.X.

* cited by examiner

CONNECTING STRUCTURE OF CONNECTOR AND FLAT CIRCUIT BODY

CROSS REFERENCE TO RELATED APPLICATIONS

This application is a continuation of PCT application No. PCT/JP2012/079046, which was filed on Nov. 2, 2012 based on Japanese Patent Application (No. 2011-242486) filed on Nov. 4, 2011, the contents of which are incorporated herein by reference.

BACKGROUND OF THE INVENTION

1. Field of the Invention

The present disclosure relates to a connector connecting structure of a connector and a flat circuit body such as a FPC (Flexible Printed Circuit) or a FFC (Flexible Flat Cable) where a plurality of conductors are arranged in a planar shape with a predetermined pitch for connecting connection terminals provided on the connector to the flat circuit body.

2. Description of the Related Art

In recent years, flat circuit bodies such as the above FPC or FFC are increasingly used as internal wiring materials of various electronic devices such as a digital camera, a printer, a cellular telephone and a Personal Computer (PC).

FIGS. 15 to 17 show an example of a related connecting structure of a connector and a flat circuit body such as a FPC or a FFC to connect the connector provided on a printed circuit board to the flat circuit body.

The connecting structure of the connector and the flat circuit body illustrated in FIGS. 15 to 17 is disclosed in JP-A-2006-85989.

The connecting structure of the connector and the flat circuit body includes a flat circuit body 110 in which a plurality of conductors are arranged in a planar shape with a predetermined pitch, a slider 120 which is attached near a distal end portion 111 of the flat circuit body 110, and a connector 130 to which the slider 120 is connected. When the slider 120 is connected to the connector 130 by being inserted into the connector 130 as shown with the arrow X1 in FIG. 15, the flat circuit body 110 is connected to the connector 130.

In the flat circuit body 110, as illustrated in FIG. 17, a plurality of connection terminal portions 112 are arranged with a predetermined pitch and exposed at the bottom surface 111*a* of the distal end portion 111.

As illustrated in FIGS. 16 and 17, the slider 120 includes a slider body 121 which is attached to a top surface of the distal end portion 111 of the flat circuit body 110, and a cover 122 which is attached to the slider body 121 from the bottom surface side of the flat circuit body 110. The slider 120 is attached to the flat circuit body 110 so that when the distal end portion 111 of the flat circuit body 110 is held between the slider body 121 and the cover 122.

As illustrated in FIGS. 16 and 17, the slider body 121 includes circuit body positioning projections 121*a*, cover retaining portions 121*b* and a housing coupling portion 121*c*.

As illustrated in FIG. 17, the circuit body positioning projections 121*a* are projections that are projected from the inner surface of the slider body 121, and are engaged with positioning holes 113 which are formed at the distal end portion 111 of the flat circuit body 110.

When the circuit body positioning projections 121*a* are fitted with the positioning holes 113, the circuit body positioning projections 121*a* regulate the movement of the flat circuit body 110 in the widthwise direction (arrow Y2 direction in FIG. 17) and regulate the movement in the lengthwise direction (arrow X2 direction in FIG. 17).

The cover retaining portions 121*b* are projections that are provided at both ends of the slider body 121 in the widthwise direction, and fix the cover 122 by being engaged with engaging holes 122*b* on engaging pieces 122*a* provided at both ends of the cover 122 in the widthwise direction. After the distal end portion 111 is positioned to the slider body 121, by fixing the cover 122 to the slider body 121, the movement of the flat circuit body 110 in the thickness direction is regulated.

The widths of the slider body 121 and the cover 122 are set to larger than the width of the distal end portion 111 of the flat circuit body 1110 so that the side edges of the distal end portion 111 of the flat circuit body 110 will not be projected laterally.

In the housing coupling portion 121*c*, a retaining projection 1212 is projected from a retaining arm 1211 which is extended on the outer surface of the slider body 121. The slider 120 is fixed to the connector 130 by making the retaining projection 1212 to be engaged with a slider retaining hole 131 (refer to FIG. 15) provided on the connector 130.

The connector 130 includes a slider containing portion 132 into which the slider 120 is inserted, the slider retaining hole 131 which fixes the slider 120 to the connector 130 by being engaged with the retaining projection 1212 on the slider 120 which is inserted into the slider containing portion 132, and a terminal arrangement portion 133 which is equipped at a position facing the slider containing portion 132.

A plurality of connection terminals 133*a* are arranged in the terminal arrangement portion 133 with a predetermined arrangement pitch. The plurality of connection terminals 133*a* are terminals that are electrically connected to the connection terminal portions 112 on the flat circuit body 110 which is attached to the slider 120.

Since the positions of the side surfaces of the slider body 121 are regulated by the inside surfaces 134 which are faced to each other in the widthwise direction of the slider containing portion 132, the slider containing portion 132 also positions the slider 120 in the widthwise direction.

With the connecting structure of the connector and the flat circuit body in JP-A-2006-85989 described above, by inserting the slider 120, which is attached to the distal end portion 111 of the flat circuit body 110, into the slider containing portion 132 to connect the slider 120 to the connector 130, the conductors of the flat circuit body 110 are electrically connected to the connection terminals of the terminal arrangement portion 133 in the connector 130.

SUMMARY OF THE INVENTION

However, with the connecting structure of the connector and the flat circuit body in JP-A-2006-85989, the flat circuit body 110 is indirectly positioned relative to the connection terminals 133*a* in the connector 130 through the slider 120.

Therefore, the allowance (dimensional tolerance) of the slider 120 is accumulated to the allowance of the distal end portion 111 in the flat circuit body 110, and variation in the positioning precision of the flat circuit body 110 relative to the connection terminal 133*a* in the connector 130 tends to occur, and there is a problem that it is difficult to improve the reliability of the electrical connection of the conductors on the flat circuit body and the connection terminals in the connector.

Thus, the object of the present disclosure is to solve the above problem and to provide a connecting structure of a connector and a flat circuit body which can make the reliability of the electrical connection of conductors on the flat circuit body and connection terminals in the connector to be improved, when the flat circuit body is connected to the connector through a slider, by improving the variation of the positioning precision of the above flat circuit body relative to the connection terminals in the connector.

The previously described object of the present disclosure is accomplished by the following construction.

There is provided a connecting structure comprising:

a flat circuit body in which a plurality of conductors are arranged on a plane surface with a predetermined pitch;

a slider that is attached to a vicinity of a distal end portion of the flat circuit body; and a connector including:

a slider containing portion to which the slider is inserted; and a terminal arrangement portion which is provided at a position facing the slider containing portion and which has a plurality of connection terminals, wherein when the slider is inserted to the slider containing portion, the conductors of the flat circuit body attached to the slider are electrically connected to the connection terminals of the terminal arrangement portion;

wherein the slider has a narrow width end portion whose width at a distal end is smaller than width of the flat circuit body so that side edges of a distal end of the flat circuit body are projected from the narrow width end portion; and wherein the slider containing portion has a positioning face which contacts with one of the side edges of the distal end of the flat circuit body which are projected from the narrow width end portion to position the flat circuit body with respect to the connector when the slider is inserted to the slider containing portion.

According to the above construction, when the flat circuit body is connected to the connector through the slider, the flat circuit body is directly positioned to the connector since the side edge of the distal end of the flat circuit body which is projected beyond the narrow width end portion of the slider contact with the positioning face provided on the connector.

Therefore, the allowance of the slider and an assembling error between the flat circuit body and the slider will not have an influence on the positioning precision of the flat circuit body on the connector.

Therefore, the variation of the positioning precision of the flat circuit body relative to the connection terminals in the connector is suppressed, and the reliability of electrical connection of the conductors in the flat circuit body and the connection terminals in the connector can be improved.

For example, the flat circuit body is attached to the slider so as to be slightly movable relative to the slider in a widthwise direction of the flat circuit body.

According to the above construction, because the flat circuit body and the slider can be relatively moved in the widthwise direction, each of the flat circuit body and the slider can be positioned to the connector individually and directly, and by improving the positioning precision of the slider relative to the connector, the attachment of the slider to the connector can be improved.

According to the connecting structure of the connector and the flat circuit body of the present disclosure, when the flat circuit body is connected to the connector through the slider, the flat circuit body is directly positioned to the connector since the side edges of the distal end of the flat circuit body which are projected beyond the narrow width end portion of the slider contact with the positioning faces for circuit body which the connector is equipped with.

Therefore, the allowance of the slider and an assembling error between the flat circuit body and the slider will not have an influence on the positioning precision of the flat circuit body on the connector.

Therefore, the variation of the positioning precision of the flat circuit body relative to the connection terminals in the connector is suppressed, and the reliability of electrical connection of the conductors in the flat circuit body and the connection terminals in the connector can be improved.

DETAILED DESCRIPTION OF THE EXEMPLARY EMBODIMENTS

A preferred embodiment of a connecting structure of a connector and a flat circuit body according to the present disclosure is described in detail with reference to the figures.

FIGS. 1 to 14B are figures which show an embodiment of a connecting structure of a connector and a flat circuit body according to the present disclosure.

As illustrated in FIGS. 1 to 4, the connecting structure of the connector and the flat circuit body of this embodiment includes a flat circuit body 10 in which a plurality of conductors are arranged in a planar shape with a predetermined pitch, a slider 20 which is attached on a vicinity of a distal end portion 11 of the flat circuit body 10, and a connector 30 to which the slider 20 is connected. When the slider 20 is connected to the connector 30 by being inserted into the connector 30 as shown with the arrow X2 in FIG. 1, the flat circuit body 10 is connected to the connector 30.

Figure 5:
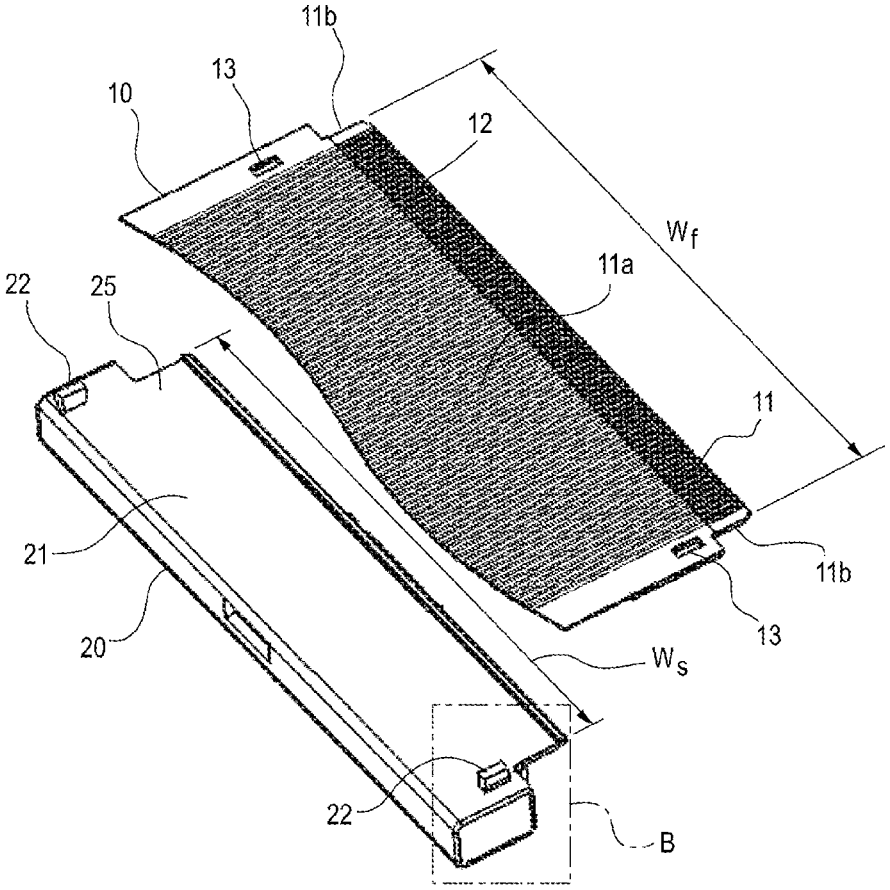
FIG. 5 is a perspective view of a structure of the slider illustrated in FIG. 1 to which the flat circuit body is attached.

In the flat circuit body 10, as illustrated in FIG. 5, a plurality of connection terminal portions, which are electrically connected to connection terminals in the connector 30 to be described later, are arranged with a predetermined arrangement pitch and exposed on the bottom surface 11*a* of the distal end portion 11. Positioning holes 13 for positioning the flat circuit body 10 to the slider 20 are formed to pass through insulative parts at two side edges close to the distal end portion 11 of the flat circuit body 10.

Figure 6:
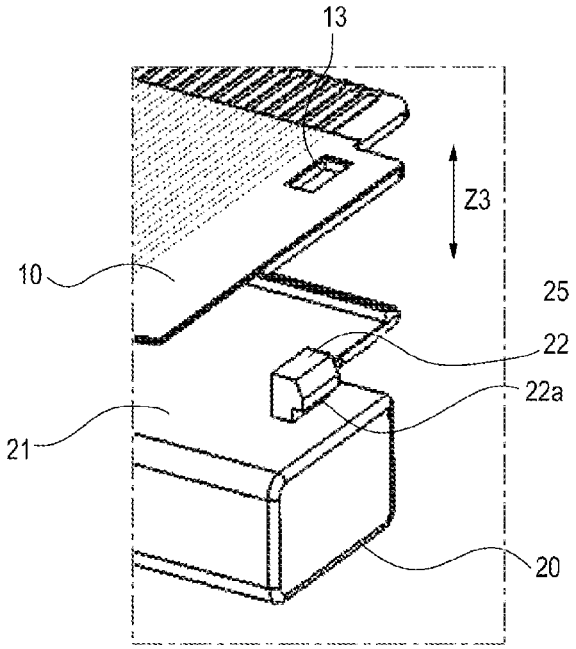
FIG. 6 is an enlarged view of a B part of the structure of the slider illustrated in FIG. 5.

As illustrated in FIGS. 5 and 6, the bottom surface of the slider 20 has a circuit body carrying surface 21 which is put upon the top surface of the distal end portion 11 of the flat circuit body 10. The circuit body carrying surface 21 includes circuit body positioning projections 22 which are fitted with the positioning holes 13 on the flat circuit body 10 to position the flat circuit body 10 when the flat circuit body 10 is put upon the circuit body carrying surface 21. Furthermore, a housing coupling portion 23 is provided on the top surface of the slider 20, as illustrated in FIG. 1.

Figure 7:
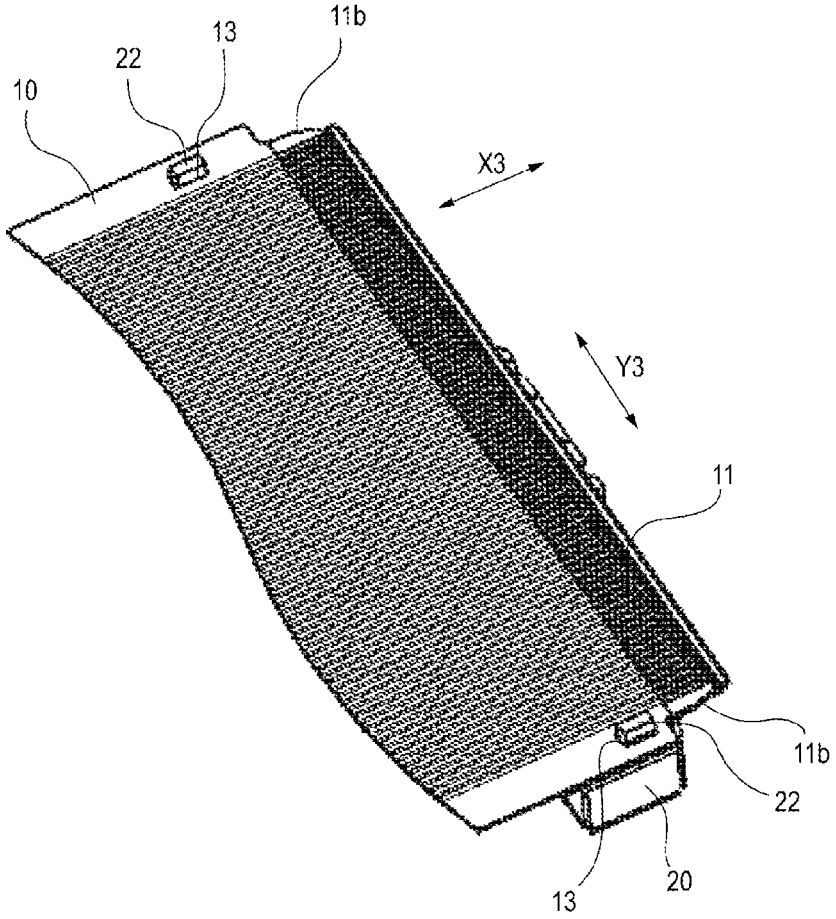
FIG. 7 is a perspective view indicating that the flat circuit body is attached to the back surface of the slider illustrated in FIG. 5.

In the present embodiment, as illustrated in FIG. 6, the circuit body positioning projections 22 are projections that are projected from the circuit body carrying surface 21. When the flat circuit body 10 is positioned after the circuit body positioning projections 22 are fitted with the positioning holes 13 as illustrated in FIG. 7, the movement of the flat circuit body 10 in the lengthwise direction (arrow X3 direction of FIG. 7) of the circuit body is regulated, and the flat circuit body 10 is positioned relative to the widthwise direction (arrow Y3 direction of FIG. 7) of the circuit body so that the relative movement of the flat circuit body 10 is permitted only for a small distance corresponding to the allowance (dimensional tolerance) of the slider 20.

As illustrated in FIG. 6, each of the circuit body positioning projections 22 has a holding portion 22*a* at the distal end for preventing the flat circuit body 10 from rising from the circuit body carrying surface 21. The circuit body positioning projections 22 regulate the movement of the flat circuit body 10 in the thickness direction (Z3 direction of FIG. 6) by pressing down the flat circuit body 10 against the circuit body carrying surface 21 with the holding portions 22*a*.

Figure 1:
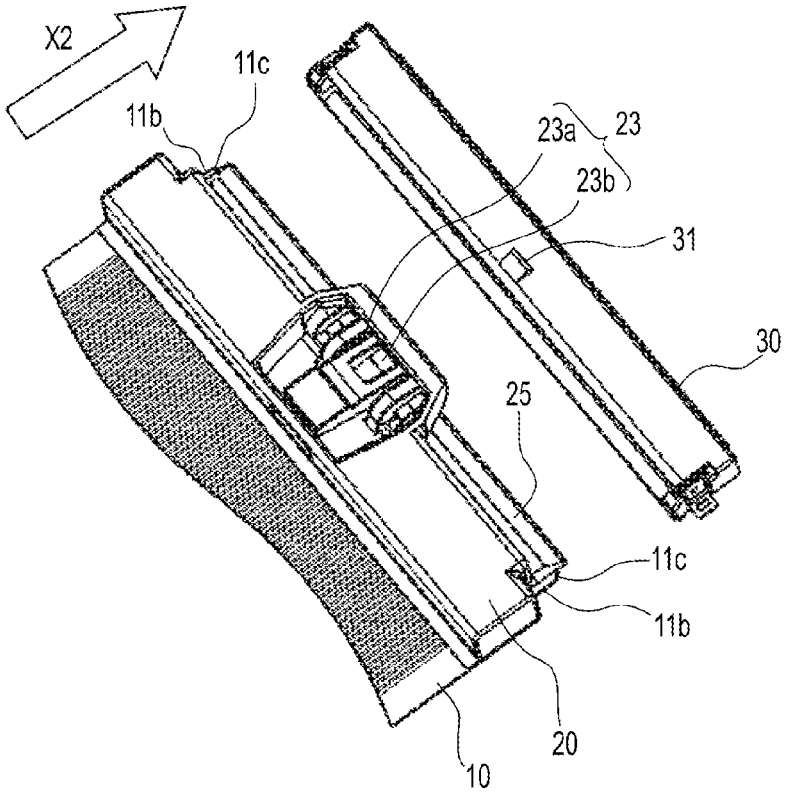
FIG. 1 is an exploded perspective view of a slider and a connector in a connecting structure of the connector and a flat circuit body according to one embodiment of the present disclosure.

The housing coupling portion 23 on the top surface of the slider 20 is a structure in which a retaining hole 23*b* is formed in a retaining arm 23*a* which is extended from the top surface of the slider 20 as illustrated in FIG. 1. The housing coupling portion 23 fixes the slider 20 to the connector 30 when the retaining hole 23*b* is engaged with a slider retaining projection 31 (refer to FIG. 10) provided on the top surface of the connector 30.

Figure 8:
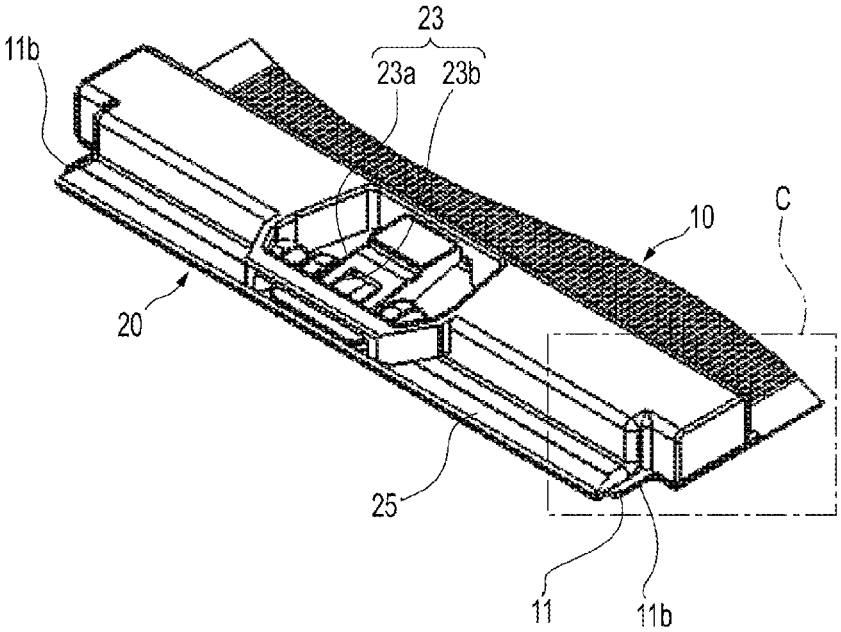
FIG. 8 is a perspective view from the front side of the slider which shows the positional relationship of a narrow width end portion in the slider of FIG. 1 and side edges of a distal end of the flat circuit body.
Figure 9:
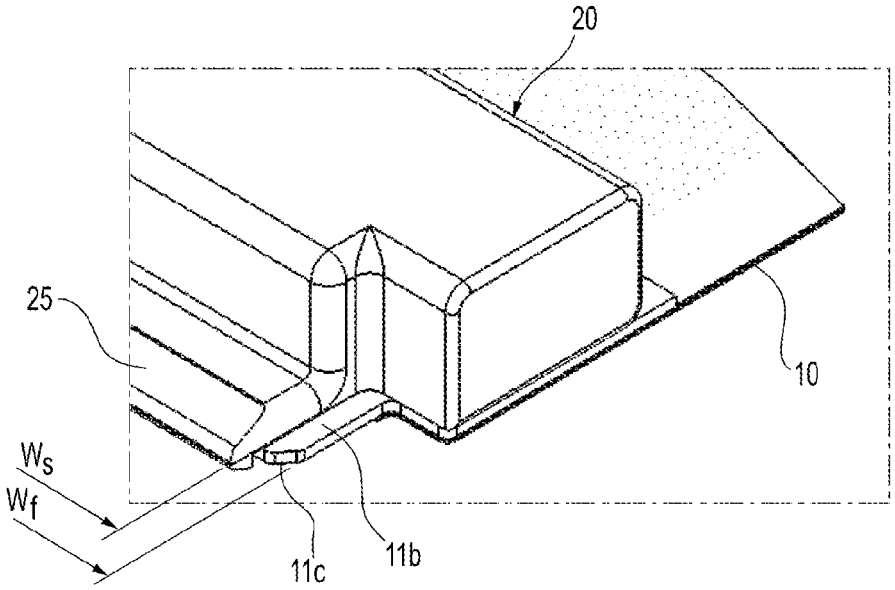
FIG. 9 is an enlarged view of a C part of the slider illustrated in FIG. 8.

The slider 20 has a narrow width end portion 25 at a distal end side which is put upon the distal end portion 11 of the flat circuit body ends 10. The width Ws (refer to FIG. 5) of the distal end side of the narrow width end portion 25 is set to be smaller than the width Wf (refer to FIG. 5) of the distal end portion 11 of the flat circuit body 10 so that, as illustrated in FIGS. 8 and 9, two side edges 11*b* of the distal end of the flat circuit body 10 are projected outwards (in the arrows direction Y3 in FIG. 7) from the narrow width end portion 25.

Figure 10:
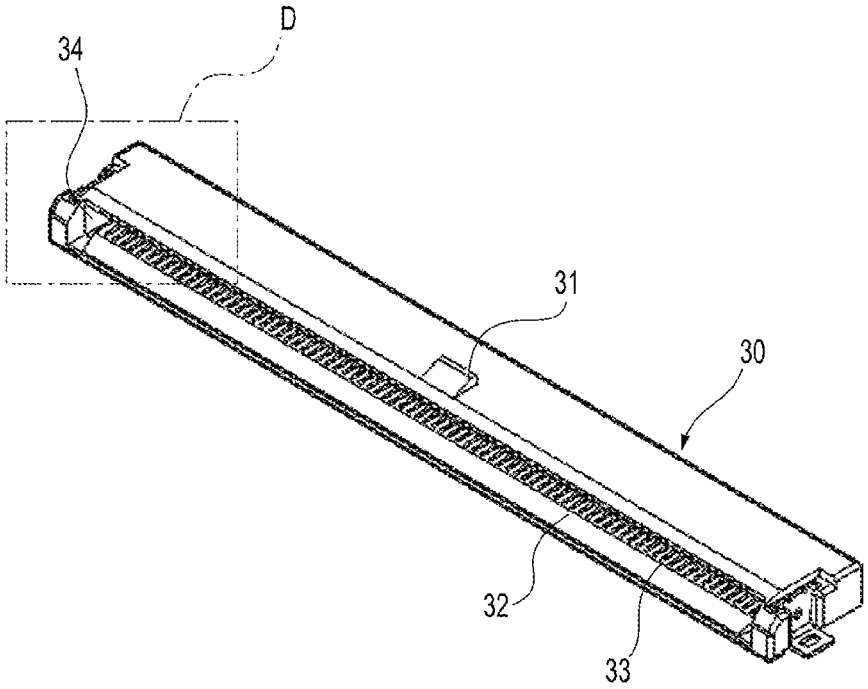
FIG. 10 is an enlarged perspective view of a slider containing portion in the connector illustrated in FIG. 1.
Figure 11:
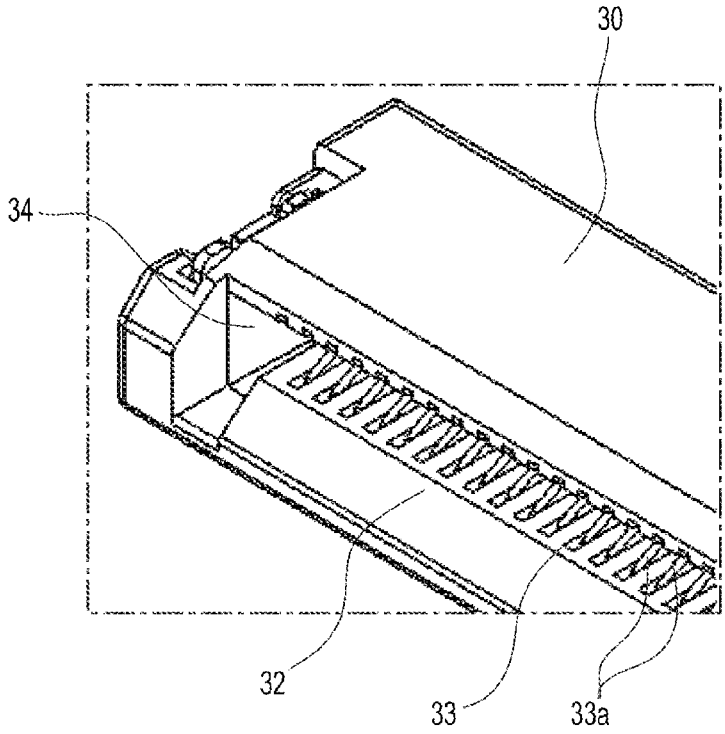
FIG. 11 is an enlarged view of a D part of the slider containing portion illustrated in FIG. 10.
Figure 12A:
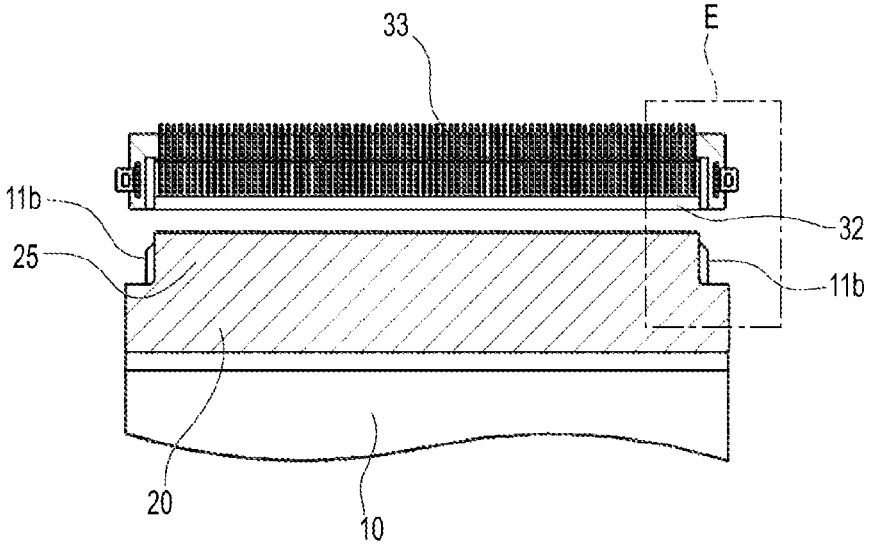
FIG. 12A is a top view indicating the positional relationship of the flat circuit body on the slider and the slider containing portion in a state before the slider is connected with the connector.
Figure 12B:
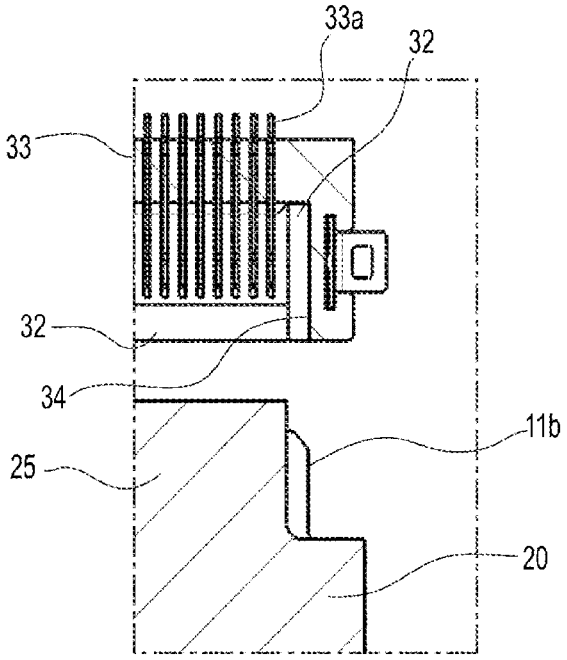
FIG. 12B is an enlarged views of an E part of FIG. 12A.

As illustrated in FIGS. 10 and 11, the connector 30 includes a slider containing portion 32 into which the slider 20 is inserted, the slider retaining projection 31 which fixes the slider 20 to the connector 30 by being engaged with the retaining hole 23*b* of the housing coupling portion 23 on the slider 20 which is inserted into the slider containing portion 32, a terminal arrangement portion 33 which is provided at a position facing the slider containing portion 32, and positioning faces for circuit body 34.

A plurality of connection terminals 33*a* are arranged in the terminal arrangement portion 33 with a predetermined arrangement pitch. The plurality of connection terminals 33*a* are electrically connected to the connection terminal portions 12 (refer to FIG. 5) on the flat circuit body 10 which is attached to the slider 20.

The positioning faces for circuit body 34 are inside surfaces which are faced to each other in the widthwise direction in the slider containing portion 32, and position the flat circuit body 10 by being contacted with the side edges 11*b* of the distal end of the flat circuit body 10 which are projected from the narrow width end portion 25 of the slider 20 when the slider 20 is inserted into the slider containing portion 32.

As illustrated in FIG. 9, a rounded portion 11*c* for facilitating the insertion into the slider containing portion 32 is formed at the distal end of the side edge 11*b* of the flat circuit body 10.

In the present embodiment, the slider 20 is positioned relative to the connector 30 in the widthwise direction of the slider 20 with the engagement of the retaining hole 23*b* of the housing coupling portion 23 provided on the slider 20 and the slider retaining projection 31.

With the connecting structure of the connector and the flat circuit body of the embodiment described above, as illustrated in FIGS. 12A and 12B, the narrow width end portion 25 of the slider 20 which is attached to the distal end portion 11 of the flat circuit body 10 is kept towards the slider containing portion 32. Then, as illustrated in FIGS. 13A to 14B, when the narrow width end portion 25 is inserted into the slider containing portion 32 to connect the slider 20 to the connector 30, the conductors of the flat circuit body 10 become electrically connected to the connection terminals 33*a* of the terminal arrangement portion 33 in the connector 30.

Figure 2:
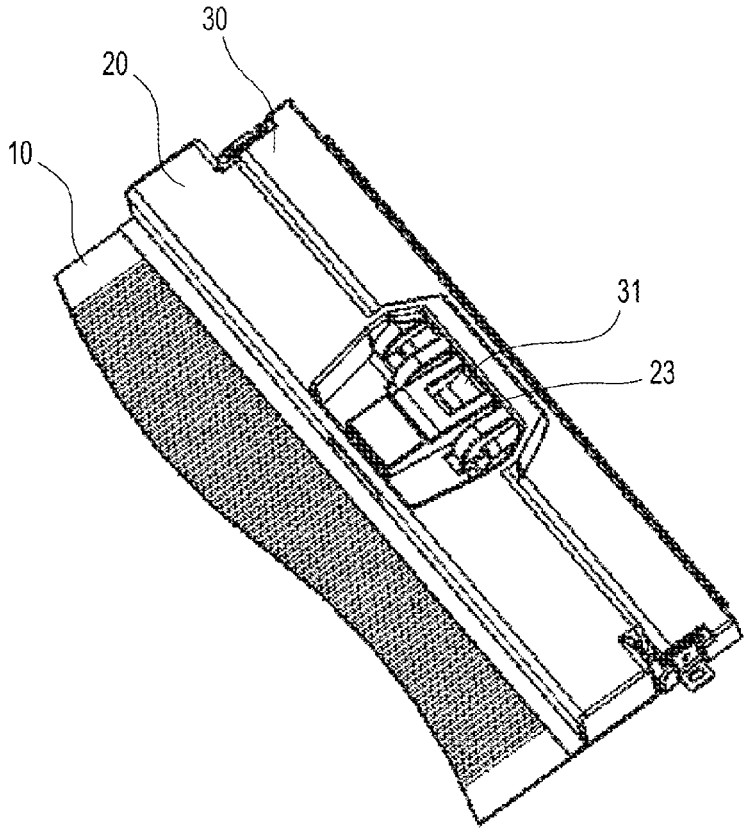
FIG. 2 is a perspective view of the slider and the connector illustrated in FIG. 1 in a connected state.
Figure 3:
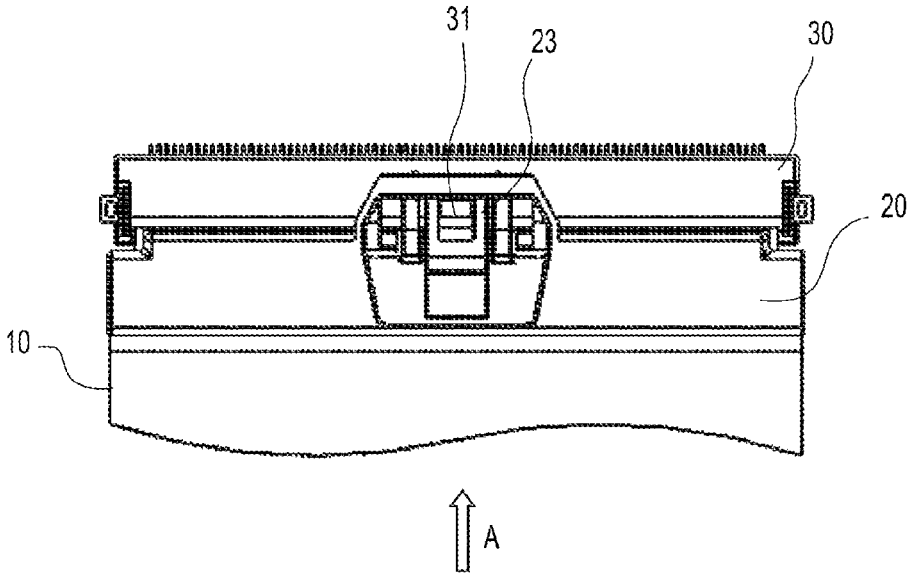
FIG. 3 is a top view of the slider and the connector illustrated in FIG. 1 in a connected state.
Figure 4:
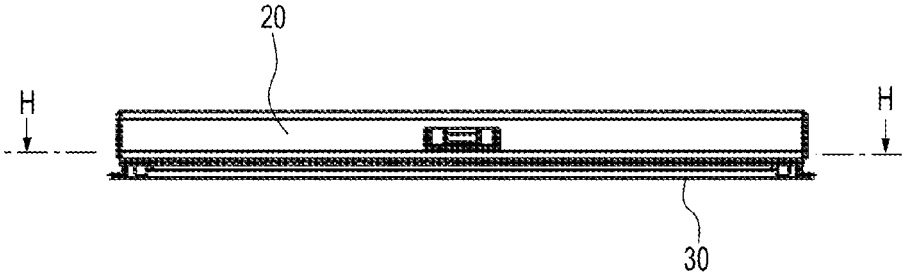
FIG. 4 is an A arrow view of the slider and the connector illustrated in FIG. 3.
Figure 13A:
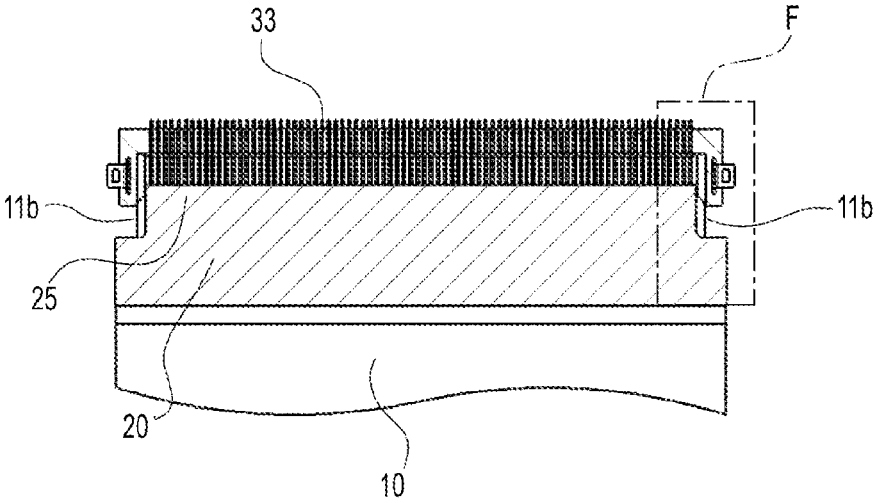
FIG. 13A is a top view indicating the positional relationship of the flat circuit body on the slider and the slider containing portion in an initial stage of connecting the slider with the connector.
Figure 13B:
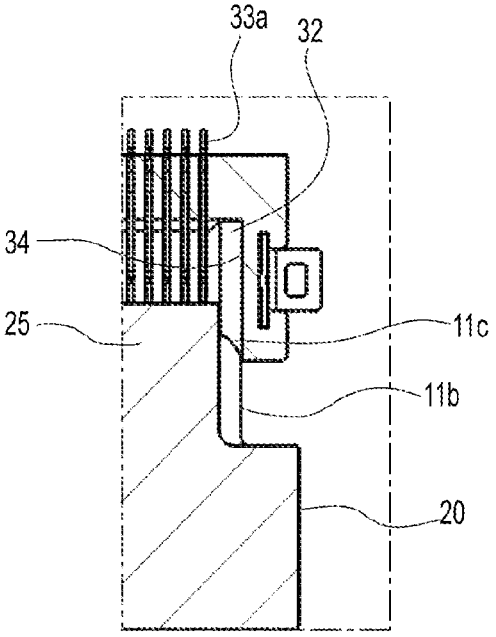
FIG. 13B is an enlarged views of an F part of FIG. 13A.
Figure 14A:
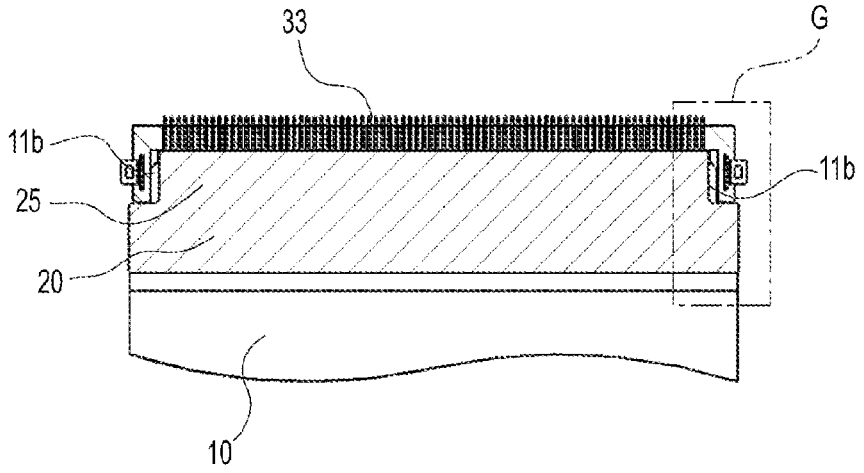
FIG. 14A is a top view indicating the positional relationship of the flat circuit body on the slider and the slider containing portion in a state after the slider has been connected with the connector and corresponds to an H-H section of FIG. 4.
Figure 14B:
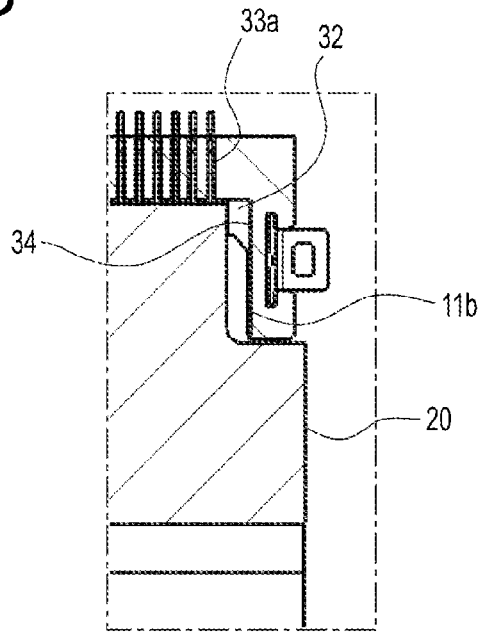
FIG. 14B is an enlarged views of a G part of FIG. 14A.
Figure 15:
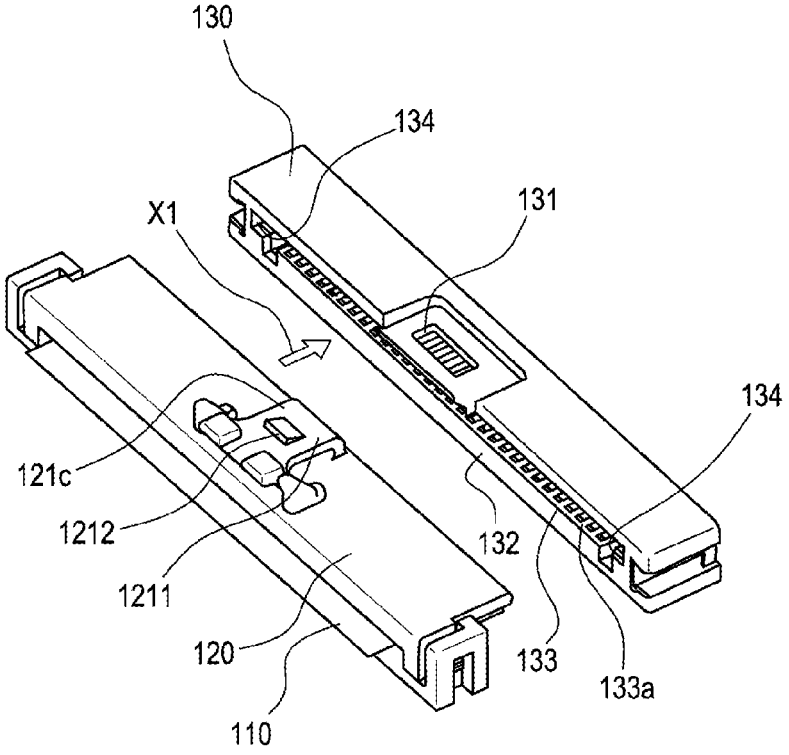
FIG. 15 is an exploded perspective view of a slider and a connector for which a related connecting mechanism of a connector and a flat circuit body is adopted.
Figure 16:
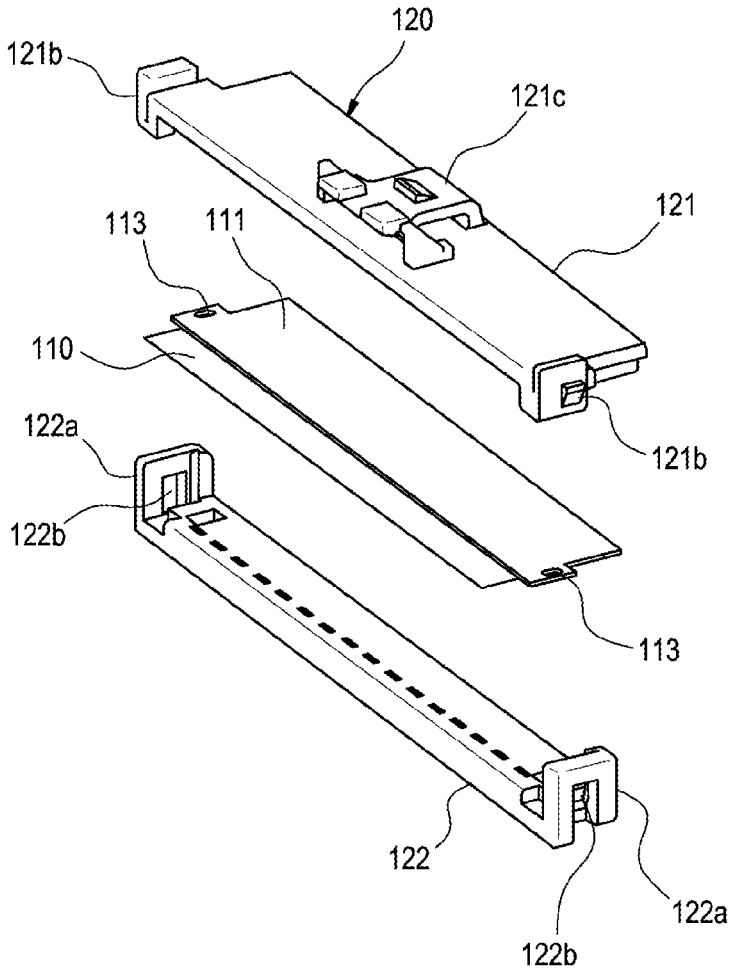
FIG. 16 is an exploded perspective view of the slider illustrated in FIG. 15.
Figure 17:
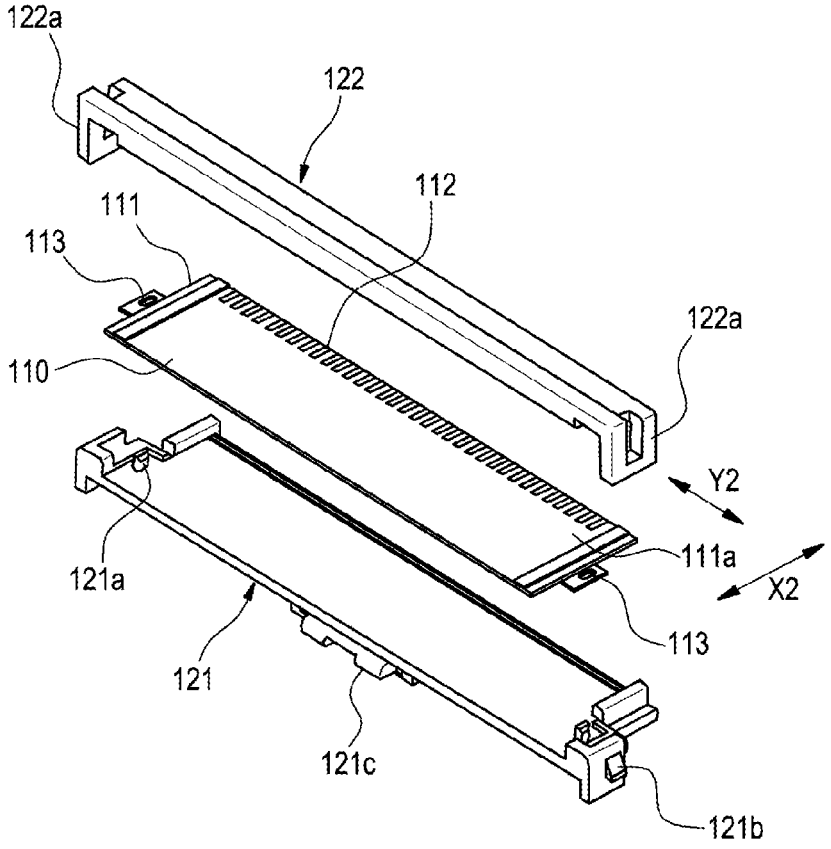
FIG. 17 is a perspective view when the components illustrated in FIG. 15 are viewed from the reverse side.

As illustrated in FIG. 13B, in the initial stage of inserting the narrow width end portion 25 into the slider containing portion 32, since the side edges 11*b* of the flat circuit body 10 which are projected beyond the narrow width end portion 25 contact with the positioning faces for circuit body 34 in the slider containing portion 32, the flat circuit body 10 is positioned in the widthwise direction relative to the connector 30. After the narrow width end portion 25 has been inserted into the slider containing portion 32 as illustrated in FIG. 14B, as illustrated in FIGS. 2 to 4, the slider retaining projection 31 on the connector 30 is engaged with the housing coupling portion 23 of the slider 20 so that the slider 20 is fixed to the connector 30.

According to the connecting structure of the connector and the flat circuit body of the embodiment described above, when the flat circuit body 10 is connected to the connector 30 through the slider 20, the flat circuit body 10 is directly positioned to the connector 30 since the side edges 11*b* of the distal end of the flat circuit body 10 which are projected beyond the narrow width end portion 25 of the slider 20 contact with the positioning faces for circuit body 34 provided on the connector 30.

Therefore, the allowance of the slider 20 and an assembling error between the flat circuit body 10 and the slider 20 will not have an influence on the positioning precision of the flat circuit body 10 on the connector 30.

Therefore, the variation of the positioning precision of the flat circuit body 10 relative to the connection terminals 33*a* in the connector 30 is suppressed, and the reliability of electrical connection of the conductors in the flat circuit body 10 and the connection terminals 33*a* in the connector 30 can be improved.

With the connecting structure of the connector and the flat circuit body of the present embodiment, because the flat circuit body 10 and the slider 20 can be relatively moved in the widthwise direction, each of the flat circuit body 10 and the slider 20 can be positioned to the connector 30 individually and directly, and by improving the positioning precision of the slider 20 relative to the connector 30, the attachment of the slider 20 to the connector 30 can be improved.

The connecting structure of the connector and the flat circuit body of the present disclosure is not limited to the above-described embodiment, and suitable modifications, improvements and the like can be made.

For example, in the previously described embodiment, when the flat circuit body is attached to the slider, the flat circuit body and the slider can be moved relatively in the widthwise direction, but it is also possible that when the flat circuit body is attached to the slider, the relative movement of the flat circuit body and the slider in the widthwise direction may be completely regulated even if there is a margin in the engaging portion of the slider and the connector for allowing a predetermined relative movement in the widthwise direction of the slider.

In the above embodiment, the two side edges 11*b* of the distal end portion 11 of the flat circuit body 10 are projected at both ends of the narrow width end portion 25 of the slider 20, but it is also possible to position the flat circuit body 10 to the connector 30 by making only one side edge 11*b* of the distal end portion 11 to be projected at one end of the narrow width end portion 25 and making the side edge 11*b* at one end abut against one positioning face for circuit body 34 of the connector 30. In this case, at the other end, the other end of the narrow width end portion 25 may abut against the inside surface of the slider containing portion 32.

By the present disclosure, the variation of the positioning precision of the flat circuit body relative to the connection terminals in the connector is suppressed, and the reliability of electrical connection of the conductors in the flat circuit body and the connection terminals in the connector can be improved.

What is claimed is:

1. A connecting structure comprising:

a flat circuit body in which a plurality of conductors are arranged on a plane surface with a predetermined pitch;

a slider that is connected to a distal end portion of the flat circuit body, the flat circuit body configured to move from a first state in which the flat circuit body is separated from the slider to a second state in which the flat circuit body is attached to the slider, the flat circuit body being configured to move from the first state to the second state in a direction orthogonal to the plane surface; and a connector including:

a slider containing portion to which the slider is inserted in an insertion direction;

a first projection extending outwardly from an exterior-facing surface of the connector in a projecting direction perpendicular to the insertion direction; and a terminal arrangement portion which is provided at a position facing the slider containing portion, the terminal arrangement portion having a plurality of connection terminals, wherein when the slider is inserted into the slider containing portion, the plurality of conductors of the flat circuit body are electrically connected to the plurality of connection terminals of the terminal arrangement portion;

wherein the slider has a narrow width end portion extending directly from a base portion of the slider, the narrow width end portion configured to be inserted into the slider containing portion while the base portion is configured to remain outside of the slider containing portion when the slider is inserted into the slider containing portion, the base portion being wider than the narrow width end portion, wherein the narrow width end portion of the slider has a maximum width smaller than a width of the flat circuit body so that side edges of a distal end of the flat circuit body extend outward a greater distance than the narrow width end portion, wherein the slider containing portion has a first positioning face which contacts one of the side edges of the distal end of the flat circuit body which extends outward a greater distance than the narrow width end portion to position the flat circuit body with respect to the connector in a direction substantially perpendicular to an insertion direction in which the slider is inserted into the slider containing portion, wherein the first positioning face of the slider containing portion is at least one of inside surfaces of the slider containing portion which face each other in the direction substantially perpendicular to the insertion direction in which the slider is inserted into the slider containing portion, wherein the slider further comprises a coupling portion configured to engage with the first projection extending from the exterior-facing surface of the connector, and wherein the slider further comprises a second projection extending in the projecting direction, the second projection configured to engage an opening in the flat circuit body, wherein the projecting direction is orthogonal to the plane surface, the opening of the flat circuit body being entirely surrounded by a remainder of the flat circuit body.

2. The connecting structure according to claim 1, wherein the flat circuit body is attached to the slider so as to be slightly movable relative to the slider in a widthwise direction of the flat circuit body.

3. The connecting structure according to claim 1, further comprising a second positioning face extending inward from the first positioning face and toward another of the inside surfaces.

4. The connecting structure according to claim 1, wherein the first projection extends from the connector in the direction orthogonal to the plane surface of the flat circuit body when inserted in the slider containing portion.

5. The connecting structure according to claim 1, wherein the narrow width end portion of the slider has a maximum width smaller than a width of the distal end of the flat circuit body, the distal end of the flat circuit body configured to be inserted into the slider containing portion.

* * * * *